US009779854B2

(12) United States Patent
Schmidt et al.

(10) Patent No.: US 9,779,854 B2
(45) Date of Patent: Oct. 3, 2017

(54) METHOD FOR PRODUCING A SEMIFINISHED PRODUCT FOR ELECTRICAL CONTACTS AND CONTACT PIECE

(75) Inventors: Andreas Schmidt, Hanau (DE); Werner Roth, Hasselroth (DE); Alexander Schade, Bruchköbel (DE); Peter Seipel, Alzenau (DE)

(73) Assignee: UMICORE AG & CO. KG, Hanau-Wolfgang (DE)

( * ) Notice: Subject to any disclaimer, the term of this patent is extended or adjusted under 35 U.S.C. 154(b) by 743 days.

(21) Appl. No.: 14/241,313

(22) PCT Filed: Aug. 24, 2012

(86) PCT No.: PCT/EP2012/066534

§ 371 (c)(1),
(2), (4) Date: Aug. 12, 2014

(87) PCT Pub. No.: WO2013/030123

PCT Pub. Date: Mar. 7, 2013

(65) Prior Publication Data

US 2014/0356646 A1 Dec. 4, 2014

(51) Int. Cl.

| | |
|---|---|
| ***B22F 7/06*** | (2006.01) |
| ***B22F 3/14*** | (2006.01) |
| ***H01B 5/02*** | (2006.01) |
| ***C22C 32/00*** | (2006.01) |
| ***H01B 1/02*** | (2006.01) |

(Continued)

(52) U.S. Cl.

CPC ..... *H01B 5/02* (2013.01); *B21C 23/205* (2013.01); *B21C 23/22* (2013.01); *B21C 33/004* (2013.01); *B22F 7/06* (2013.01); *C22C 32/0021* (2013.01); *H01B 1/02* (2013.01); *H01B 13/0036* (2013.01); *B22F 2998/10* (2013.01); *Y10T 428/1266* (2015.01); *Y10T 428/12896* (2015.01)

(58) Field of Classification Search

None

See application file for complete search history.

(56) References Cited

U.S. PATENT DOCUMENTS 3,560,170 A * 2/1971 Durrwachter ..... B21C 23/01 428/565
3,864,827 A * 2/1975 Schreiner ..... H01H 1/0233 200/264

(Continued)

FOREIGN PATENT DOCUMENTS

| | | |
|---|---|---|
| CN | 101350255 | 1/2009 |
| DE | 10 2008 056263 | 5/2010 |

(Continued)

OTHER PUBLICATIONS

Sakairi, K. et al. Manufacturing Process and Characteristics of $AgnO_2$ for Electrical Contact Materials. Holm Conference on Electrical Contacts.1982. pp. 77-85.

(Continued)

*Primary Examiner* — Colleen Dunn

(74) *Attorney, Agent, or Firm* — Smith, Gambrell & Russell, LLP

(57) ABSTRACT

The present invention relates to a novel method for producing metallic semifinished products by extrusion, to the thus obtainable semifinished products and to contact pieces that can be produced therefrom.

23 Claims, 1 Drawing Sheet

(51) Int. Cl.

| | |
|---|---|
| ***H01B 13/00*** | (2006.01) |
| ***B21C 23/20*** | (2006.01) |
| ***B21C 23/22*** | (2006.01) |
| ***B21C 33/00*** | (2006.01) |

(56) References Cited

U.S. PATENT DOCUMENTS

| | | | | |
|---|---|---|---|---|
| 4,243,413 | A * | 1/1981 | Shibata | B22F 3/14 148/431 |
| 4,834,939 | A * | 5/1989 | Bornstein | C22C 32/0021 419/19 |
| 8,980,166 | B2 * | 3/2015 | Heinzel | H01R 13/03 419/11 |
| 8,992,826 | B2 * | 3/2015 | Heinzel | A61L 27/20 419/5 |
| 2011/0243783 | A1 | 10/2011 | Heinzel et al. | |
| 2011/0262293 | A1 | 10/2011 | Heinzel et al. | |

FOREIGN PATENT DOCUMENTS

| | | | |
|---|---|---|---|
| WO | 2010/051923 | | 5/2010 |
| WO | WO2010051923 | * | 5/2010 |
| WO | WO2010051922 | * | 7/2010 |

OTHER PUBLICATIONS

Written Opinion of the International Search Authority for PCT/EP2012/066534 dated Feb. 26, 2014 (German with English Translation) 12 pages.

International Preliminary Report on Patentability for PCT/EP2012/066534 dated Mar. 4, 2014 (German with English Translation) 14 pages.

International Search Report for Application No. PCT/EP2012/066534 mailed Nov. 21, 2012.

Office Action issued on Dec. 26, 2016 in Chinese Patent Application No. 201280041325.3 (24 pages in Chinese with English machine translation).

* cited by examiner a) b) c)

METHOD FOR PRODUCING A SEMIFINISHED PRODUCT FOR ELECTRICAL CONTACTS AND CONTACT PIECE

FIELD OF THE INVENTION

Composite materials based on silver having incorporated oxide or carbon particles (what are called contact materials) often have poor welding and soldering properties. In the production of semifinished products for electrical contacts, the bottom side, i.e. the side remote from the opposing contact, of the contact material is therefore provided with a readily solderable or weldable carrier layer, which often consists of silver or a silver alloy. Carrier layers of this type are often applied by plating a silver strip onto contact materials. It is disadvantageous in this case that the bond strength in this method does not always satisfy the requirements. Also known is a method for producing individual contacts, in which a layer of contact material powder is applied to a layer of silver powder, the two powder layers are pressed and sintered together and in this way a semifinished product having a front side made of contact material and a rear side made of solderable or weldable silver or based on silver is produced. Strip-like semifinished product is not obtainable in this way, however. It is further known to encapsulate a contact material block with a silver tube and to form it by composite extrusion. A semifinished product having a top side made of contact material and a bottom side made of silver can be obtained by longitudinally dividing a composite strand produced in this way. The production of a suitable silver tube and the fitting or production of a contact material block in the silver tube are complex, however.

It is further known to encapsulate a block made of contact material with silver powder, to carry out pressing, to carry out sintering and to carry out extrusion, with the strand being divided. It is disadvantageous in this case that a die having a plurality of openings has to be used, leading to shorter semifinished product lengths, or subsequent single-sided removal of the silver layer is required on the later contact side.

BRIEF DESCRIPTION OF THE INVENTION

It is an object of the invention to show a way in which it is possible to cost-effectively produce a strand-like semifinished product for electrical contacts which has a top side, which is intended for making the electrical contact and is made of a silver-based contact material, and a bottom side made of a carrier material, in particular silver or a silver alloy.

This object is achieved by a method as per the following points:

1. A method for producing a strand-like, in particular strip-like, semifinished product for electrical contacts, wherein the semifinished product has a top side, which is intended for making the electrical contact and is made of a silver-based contact material, in which one or more metal oxides or carbon are incorporated, and a carrier layer, which bears the contact material and is readily solderable or weldable, said method having the following steps:

producing a block from the silver-based contact material, partially encapsulating the block made of the contact material with the material of the carrier layer, pressing the encapsulated block to compact the metal powder, in order to obtain a composite block, sintering the pressed composite block, in order to obtain a sintered composite block, forming the sintered composite block by extrusion.

2. The method as per point 1, characterized in that the block made of the contact material is encapsulated with a metal powder consisting of the material of the carrier layer.

3. The method as per either of the preceding points, characterized in that the carrier layer consists of silver, copper, nickel, aluminum, iron and the base alloys thereof.

4. The method as per one of the preceding points, characterized in that the contact material is a silver-metal oxide composite material.

5. The method as per one of the preceding points, characterized in that the silver-based contact material contains tin oxide and/or zinc oxide and/or indium oxide and/or cadmium oxide.

6. The method as per one of the preceding points, characterized in that a metallic powder mixture or sheets or foils made of silver, copper, nickel, aluminum, iron or the base alloys thereof is used to encapsulate the block made of the contact material.

7. The method as per one of the preceding points, characterized in that silver powder or powder made of a silver base alloy is used to encapsulate the block made of the silver-based contact material.

8. The method as per one of the preceding points, characterized in that the encapsulated block is subjected to isostatic, preferably cold isostatic, pressing.

9. The method as per one of the preceding points, characterized in that the extrusion is carried out at temperatures of 600° C. to 950° C., in particular 700° C. to 850° C.

10. The method as per one of the preceding points, characterized in that the thickness of the strand or of a partial strand produced by extrusion is reduced by rolling.

11. The method as per one of the preceding points, characterized in that the two flanks of the strand, which extend from the contact-making top side as far as the readily solderable and weldable bottom side of the strand formed by the carrier layer, are trimmed.

12. The method as per one of the preceding points, characterized in that the flanks of the strand are trimmed by cutting or milling.

13. The method as per one of the preceding points, characterized in that an approximately cylindrical sintered block is produced, the lateral surface of which is turned before the extrusion.

14. The method as per one of the preceding points, characterized in that the block is formed, by the extrusion, from a rectangular or cylindrical shape into a shape with a rectangular cross section.

15. The method as per one of the preceding points, characterized in that the contact material is obtained by powder metallurgy.

16. The method as per one of the preceding points, characterized in that the three steps of producing a block from the silver-based contact material, partially encapsulating the block made of the contact material with the material of the carrier layer, and pressing the block encapsulated with the metal powder to compact the metal powder, in order to obtain a composite block, are carried out simultaneously.

17. The method as per one of the preceding points, characterized in that the material of the carrier layer contains metal oxides, in particular the same metal oxides as the contact material used.

18. The method as per one of the preceding points, characterized in that the material of the carrier layer and the contact material differ from one another.

19. The method as per one of the preceding points, characterized in that the wrap-around angle is smaller than 360° or 90° to 270° or 120° to 180° or 100° to 130°.

20. A semifinished product, produced by a method as per one of the preceding points, in particular a strip-like semifinished product.

21. An electrical contact piece, produced by cutting from the semifinished product as per point 20 and optionally forming the cutting.

DETAILED DESCRIPTION OF THE INVENTION

Figure 1:
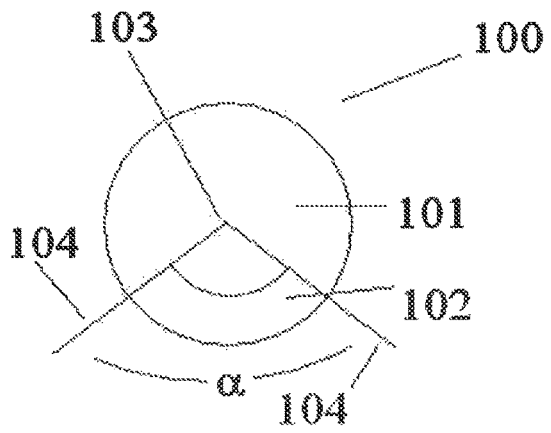
FIG. 1 shows a cylindrical (=circular cross section) composite block 100, which consists of a contact material 101 partially encapsulated by a carrier material 102, where the wrap-around angle α denotes the encapsulated extent spanned by two lines 104 connected to the center point of the cross section 103.

In the method, a block is produced from a silver-based contact material, and the block produced is partially encapsulated with silver powder or powder made of a silver base alloy and pressed to compact the powder encapsulation.

In the method, use can be made of a contact material which is a silver-metal oxide composite material. Metal oxides which can be used are in particular tin oxide, zinc oxide, indium oxide, tellurium oxide, copper oxide, cadmium oxide, bismuth oxide, tungsten oxide, molybdenum oxide or combinations thereof. In this case, it is possible for the contact material used to contain a plurality of metal oxides. Similarly, it is possible for the contact material to contain only a single metal oxide. It is preferable that the metal oxide component of the contact material consists predominantly of tin oxide. As an alternative or in addition to metal oxides, the silver-based contact material used can also contain carbon, for example in the form of graphite or tungsten carbide. Other contact materials can be, for example, silver with tungsten carbide, silver with tungsten carbide and carbon, silver with tungsten.

These contact materials can be used in combination with a material as a carrier layer. Silver, copper, nickel, aluminum, iron and the base alloys thereof are suitable as the material of the carrier layer. Also suitable are silver base alloys, such as silver-nickel alloys or silver-nickel alloys with a 20% nickel proportion (AgNi20), but also alloys of copper with nickel, copper with silver or copper with tin, bronzes or else brass. If common metals are used as the material of the carrier layer or if common metals are present, for example in silver-nickel alloys, the further processing can take place with exclusion of oxygen, which can be achieved for example by working in a nitrogen atmosphere or, in the case of powder metallurgy processing, by using an organic coating of the powder particles as a sintering aid.

The block made of contact material can be produced by powder metallurgy. In this respect, these steps of producing the block from contact material and the step of partial encapsulation with a silver powder or powder made of a silver base alloy and pressing can be carried out both in sequence and simultaneously.

If the production of the block from contact material and the partial encapsulation and pressing are carried out in sequence, the block can be produced from contact material, for example, by mixing silver powder with metal oxide powder, for example metal oxide powders of tellurium, indium, tin, zinc, copper, cadmium, bismuth, molybdenum, tungsten or combinations thereof, carrying out pressing and then carrying out sintering.

In another embodiment of the invention, silver powder is mixed with a common metal powder such as tellurium, indium, tin, zinc, copper, cadmium, bismuth, molybdenum, tungsten or combinations thereof, pressing is carried out and then sintering is carried out in an oxidizing atmosphere, so that oxidation of the common metal particles forms metal oxide particles.

In another embodiment of the invention, an alloy of silver with one or more common metals, in particular tellurium, indium, tin, zinc, copper, cadmium, bismuth, molybdenum, tungsten or combinations thereof, is obtained by melt metallurgy, and is then heat-treated in an oxidizing atmosphere, so that oxidation of the common metal particles forms metal oxide particles. For increasing the ductility, the block made of contact material can optionally be subjected to a heat treatment, which brings about coarsening of the oxides by Ostwald ripening and a resultant improvement in the ductility (see Sakairi et al., Holm Conference on Electrical Contacts—1982, pages 77-85).

Once a block made of a contact material has been obtained in one of the above ways, in a second step, the block made of contact material is partially encapsulated with the material of the carrier layer. The block can be partially encapsulated, for example, with a copper or silver powder, or powder made of a silver base alloy, and then pressed to compact the powder encapsulation. The pressing can be isostatic pressing, to be precise cold or hot isostatic pressing. Silver, copper, nickel, aluminum, iron and the base alloys thereof are suitable as the material of the carrier layer, as described above. If an alloy is used as the material of the carrier layer, use can be made of alloy powders or mixtures of element powders, and these are equally suitable.

However, the subsequent step of partial encapsulation can also be carried out in such a way that some of the surface of the block made of a contact material is removed down to the desired depth and is then filled again with the material of the carrier layer.

This can be done using powder made of the material of the carrier layer, i.e. made of silver, copper, nickel, aluminum, iron and the base alloys thereof, which is applied either by thermal spraying, such as flame spraying or cold gas spraying, or by filling with a powder made of the material of the carrier layer with subsequent pressing and sintering. In this case, other metal powder can also be admixed to the powder made of the material of the carrier layer (such as for example silver, copper, nickel, aluminum, iron), in order to thereby produce, by powder metallurgy, an encapsulation made of a base alloy, i.e. an alloy consisting predominantly of this metal. By way of example, use can be made of a silver powder mixed with a common metal powder such as for example nickel, in order to obtain, for example, a silver base alloy such as AgNi20 as the material of the carrier layer.

Similarly, the material of the carrier layer can be applied in the form of one or more appropriately shaped metal sheets, which fill the removed part again. Metal sheets of this type can be fastened by common processes such as sintering, possibly with a powder substrate, welding, isostatic pressing, screwing or the like.

The above embodiments describe a sequential procedure. If the production of the block from contact material and the partial encapsulation and pressing are carried out simultaneously, it is possible to use a powder made of a contact material or a mixture of silver powder with metal oxide powder, such as for example mixtures with metal oxide powders of tellurium, indium, tin, zinc, copper, cadmium, bismuth, tungsten, molybdenum or combinations thereof, and this powder or mixture can be introduced into a mold provided with separating plates. At the same time, or in a subsequent step, the powder bed or the mixture of contact material or silver powder and metal oxide powder is partially encapsulated with a powder made of the material of the carrier layer (such as silver powder or powder of a silver base alloy), in that the powder of the material of the carrier layer is introduced into the region separated by separating plates from the powder for producing the contact material, the separating plates are removed and then pressing is carried out to compact the powder encapsulation, in order to obtain a (pressed) composite block.

Figure 2:
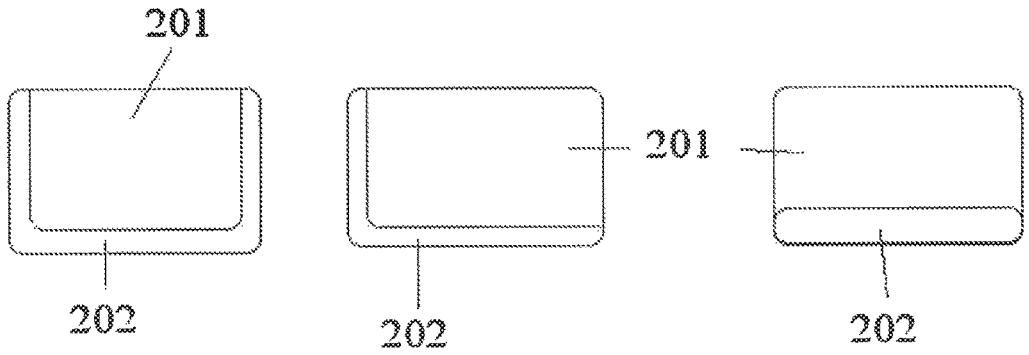
FIG. 2 shows a cuboidal (=rectangular cross section) composite block made of contact material 201 partially surrounded by a carrier material 202, where the wrap-around angle is 270° in FIG. 2*a,* 180° in FIG. 2*b* and 90° in FIG. 2*c*.

In another embodiment of the invention, the material of the carrier layer can be placed into the mold in the form of one or more appropriately shaped metal sheets or foils, and the powder for producing the contact material can be introduced. The pressing can then be isostatic pressing, to be precise cold or hot isostatic pressing. In contrast to encapsulation, "partial encapsulation" is to be understood as meaning that some of the block made of contact material is not encapsulated at the surface with the material of the carrier layer, such as for example the silver powder or powder made of a silver base alloy, and therefore during the method some of the contact material always remains uncovered by carrier material and is exposed. The degree of coverage of the block made of contact material is indicated by the wrap-around angle. This is explained in more detail in FIG. 1. The composite block 100 consists in part of contact material 101 and of a partial encapsulation of carrier material 102. If the center point 103 of the cross section of the composite block and the outermost ends of the encapsulation are connected by straight lines, the two straight lines span the wrap-around angle $\alpha$. For the encapsulation (i.e. complete enclosure) of a block made of contact material with the carrier material, the wrap-around angle is always 360°, and for partial encapsulation it is consequently smaller than 360°. In one embodiment of the invention, the wrap-around angle is between 90° and 270°, in a further embodiment of the invention it is between 120° and 180° and in a further embodiment of the invention it is between 100° and 130°. FIG. 2 shows various wrap-around angles of 270°, 180° and 90° on a contact material block with a rectangular cross section, but it is also possible, of course, for the cross section to be round.

In all of the above embodiments, the powders can be pressed at pressures of 500 bar to 10 000 bar, or of 500 bar to 2000 bar, or 800 bar to 1200 bar. The pressing method used can be isostatic pressing. The isostatic pressing can be carried out at room temperature (cold isostatic) or at elevated temperatures (hot isostatic). A composite block is obtained in this way.

In a further production step, the composite block (which has advantageously been subjected to cold isostatic pressing) is sintered and then formed by extrusion. The sintering is to be carried out in an atmosphere in which the common metal does not oxidize and the metal oxides are not decomposed, as is the case in vacuo or under a nitrogen atmosphere. Since the contact material and the carrier material have different degrees of shrinkage during sintering or pressing, warpage and cracking can readily occur during sintering. For the method, however, it can be advantageous if the sintered composite block obtained by sintering has a low degree of warpage and is free of cracks. This can be achieved by pressing the pressed composite block to a high density, which can be effected, for example, by hydraulic pressing at pressures of 1000 to 10 000 bar, or 500 bar to 2000 bar, and at temperatures of from room temperature, i.e. approximately 20° C., to 500° C. As an alternative thereto, the shrinkage behavior during pressing and sintering can also be controlled by matching the materials to one another. Since the contact material is usually prespecified, the matching can often only be done by way of the carrier material. The matching can be controlled by way of the stoichiometry of the carrier material, and use can be made for example of a silver base alloy. Suitable in this respect are, for example, silver-nickel alloys, such as silver-nickel alloys having a 20% nickel proportion (AgNi20). These can either be used in molten and atomized form as a powder, or else can be obtained via a metallic powder mixture made of element powders of silver and nickel. Silver with oxide additives, for example tin oxide, is likewise suitable. The oxide can be obtained via a powder mixture of the oxide with silver, where the oxide should be added in smaller quantities than in the contact material so as not to significantly impair the wear and soldering properties. A further possible way to control the shrinkage behavior is the selection of the powder particle size. In this respect, it is possible to achieve a good effect by selecting a metal or alloy powder for producing the carrier material having a greater particle size than the particle size of the metal powder for the production of the contact material. In general, in this case, the metal or alloy powder for producing the carrier material can have a mean particle size D50 of >50 μm and the metal powder for the production of the contact material can have a mean particle size D50 of 1-20 μm.

After the sintering, the material of the carrier layer (silver or silver base alloy) generally already bonds to a sufficient extent to the block, and therefore this can be shaped and therefore can be inserted into an extrusion tool with an accurate fit. By way of example, isostatic pressing and subsequent sintering, as described above, make it possible to produce an approximately cylindrical composite block, the lateral surface of which can be turned before the extrusion, in order to clean the surface or, if required, to bring about adaptation to the internal dimensions of an extrusion tool. Then, by virtue of the extrusion, the composite block can be formed from a cylindrical shape into a shape with a rectangular cross section, the desired semifinished product. This procedure has certain advantages in the use of composite blocks weighing up to about 60 kg.

As an alternative thereto, in a similar method, a composite block having a rectangular cross section can also be produced and similarly further processed. This procedure facilitates the orientation of that part of the composite block which is coated with the material of the carrier layer with respect to the die of the extruder, and has certain advantages in the use of composite blocks weighing up to about 10 kg.

In a further method step, the (sintered) composite block is formed by extrusion. To this end, the composite block is usually heated to temperatures of 600° C. to 900° C. or of 700° C. to 800° C., and introduced into an extrusion container preheated to 300° C. to 600° C., usually 450° C. to 550° C., for instance 500° C. Both direct and indirect composite extrusion can be employed, where indirect composite extrusion makes it possible to achieve good results, since a material flow and layer thickness ratio which are more uniform over the length are achieved by indirect composite extrusion during the hot forming.

In this case, the composite block is placed into the mold of an extruder, and that part of the composite block which is coated with the material of the carrier layer is oriented with respect to the die of the extruder in such a way that the coating with the carrier layer is achieved on the desired side of the strand. Then, by extrusion a strand having a top side made of contact material and a bottom side made of the material of the carrier layer, such as silver, copper, nickel, aluminum, iron and the base alloys thereof, such as silver-nickel alloys or silver-nickel alloys having a 20% nickel proportion (AgNi20), alloys of copper with nickel, copper with silver or copper with tin, bronzes or brass is manufactured.

The extrusion is preferably carried out at temperatures of 600° C. to 950° C., in particular 700° C. to 850° C. The extrusion can advantageously achieve a high degree of compaction, and therefore the strand has a relative density of 99.9% of the theoretically possible density.

The extrusion method can be adapted to the respective specific conditions and the desired products by further adjustments, such as the die design (adaptation of entry angle and guide length) and also the pressing parameters for the extrusion (adaptation of the pressing speed, block temperature, ratio of block diameter to block length).

In one embodiment, the two flanks of the strand, which extend from the contact-making top side as far as the readily solderable and weldable bottom side of the strand, are trimmed, in particular by cutting or milling. The same effect can be achieved by dividing the strand, in that the strand is divided twice at a distance of a few millimeters from the side edges of the strand. This makes it possible to ensure that no material of the carrier layer passes onto the contact surface and impairs the function thereof during the further processing of the semifinished product or during the later use of an electrical contact produced using the semifinished product.

Then, the thickness of the strand produced by extrusion can optionally be reduced by rolling, in particular by cold rolling. A thickness reduction of at most 50% of the original thickness is to be recommended during the cold rolling in order to avoid an excessive change in the mechanical properties of the semifinished product, for example an increase in the hardness.

If appropriate, the cold rolling is carried out in a plurality of stages with a smaller degree of thickness reduction and heat treatments. In one embodiment of the invention, the thickness of the strand is reduced by 30 to 50% of its original thickness during the rolling. In a further embodiment of the invention, the thickness of the strand is reduced to less than half by hot rolling and processed to final dimensions by cold rolling. Electrical contact pieces can be produced from the thus obtained strand-like or strip-like semifinished product by methods known per se, such as by cutting or punching from the semifinished product, and possibly forming of the cutting.

EXAMPLES

1. A cylindrical block made of a silver-based contact material is produced by mixing silver powder and tin oxide powder, cold isostatic pressing and subsequent sintering. By way of example, this block can consist to an extent of 8 to 14% by weight of the metal oxide, remainder silver. A third of the lateral surface of the contact material block is encapsulated with silver powder and then subjected to cold isostatic pressing. The block which has been subjected to isostatic pressing is then sintered under air at 800° C. to 900° C., for example for 2 to 5 hours. If necessary, the sintered block is then turned, so that it can be inserted into an extruder with a precise fit. If the process is configured appropriately, turning is not required. The block is then formed from its cylindrical shape into a shape with a rectangular cross section by extrusion at a temperature of 750° C. to 800° C.

The flanks of the thus produced strand are cut off. The strip-like semifinished product produced in this way has a carrier layer, the thickness of which amounts to about 10% to 30% of the thickness of the contact material layer, and can be used for producing electrical contact pieces, in that rolling is carried out to the required final thickness, cuttings are cut from the semifinished product and these are formed according to the requirements of a specific application.

2. A powder mixture is obtained by mixing silver powder with 8 to 14% by weight tin oxide powder. This powder mixture is introduced into a cylindrical mold, provided with separating plates, for cold isostatic pressing, where the separating plates partition off a surface segment which makes up approximately a third of the surface of the composite block to be obtained. A silver powder is simultaneously introduced into this hollow space spanned by the separating plates. As soon as the mold has been filled, the separating plates are removed by being pulled out, cold isostatic pressing is carried out and sintering is carried out. The block which has been subjected to isostatic pressing is then sintered under air at 800° C. to 900° C., for example for 2 to 5 hours. A third of the contact material block is encapsulated with silver powder. The block is then formed from its cylindrical shape into a shape with a rectangular cross section by extrusion at a temperature of 750° C. to 800° C., and the flanks of the strand are cut off. The strip-like semifinished product produced in this way has a carrier layer, the thickness of which amounts to about 10% to 30% of the thickness of the contact material layer, and can be used for producing electrical contact pieces, in that cuttings are cut from the semifinished product and these are formed according to the requirements of a specific application.

The invention claimed is:

1. A method for producing a semifinished product for electrical contacts, wherein the semifinished product has a top side, which is intended for making the electrical contact and is made of a silver-based contact material, in which one or more metal oxides or carbon are incorporated, and a carrier layer, which bears the contact material and is readily solderable or weldable, said method having the following steps:

producing a block from the silver-based contact material, after producing the block made of the contact material, partially encapsulating a peripheral surface of the block made of the contact material with the material of the carrier layer, pressing the partially encapsulated block to compact the carrier layer material, in order to obtain a composite block, sintering the pressed composite block, in order to obtain a sintered composite block, forming the sintered composite block by extrusion, which extrusion involves extruder contact with both the partially encapsulating carrier layer material as well as the peripheral surface of the block made of the contact material.

2. The method as claimed in claim 1, wherein the carrier layer is formed from a metal powder that is used to partially encapsulate the block made of the contact material.

3. The method as claimed in claim 1, wherein the material of the carrier layer is selected from the group consisting of silver, copper, nickel, aluminum, iron and the base alloys thereof.

4. The method as claimed in claim 1, wherein the silver-based contact material contains tin oxide and/or zinc oxide and/or indium oxide and/or cadmium oxide.

5. The method as claimed in claim 1, wherein the carrier layer is formed from a metallic powder mixture or sheets or foils made of silver, copper, nickel, aluminum, iron or the base alloys thereof which is used to partially encapsulate the block made of the contact material.

6. The method as claimed in claim 1, wherein the carrier layer is formed from silver powder or powder made of a silver base alloy which is used to partially encapsulate the block made of the silver-based contact material.

7. The method as claimed in claim 1, wherein the partially encapsulated block is subjected to isostatic pressing.

8. The method as claimed in claim 1, wherein the extrusion is carried out at temperatures of 600° C. to 950° C.

9. A semifinished product, produced by a method as claimed in claim 1.

10. An electrical contact piece, produced by cutting from the semifinished product as claimed in claim 9 and forming the cutting.

11. The semifinished product of claim 9 wherein the semifinished product has a strip form.

12. A method for producing a semifinished product for electrical contacts, wherein the semifinished product has a top side, which is intended for making the electrical contact and is made of a silver-based contact material, in which one or more metal oxides or carbon are incorporated, and a carrier layer, which bears the contact material and is readily solderable or weldable, said method having the following steps:

producing a block from the silver-based contact material, after producing the block, contacting a peripheral surface of the block with carrier layer material such that the carrier layer material extends only partially about the peripheral surface so as to define both a partially encapsulated peripheral block section and an exposed peripheral block section, pressing the partially encapsulated block to compact the carrier layer material, in order to obtain a composite block, sintering the pressed composite block, in order to obtain a sintered composite block, extruding, though an extrusion die, the sintered composite block such that the exposed peripheral block section comes in contact with the die.

13. The method of claim 12 wherein the semifinished product is a rectangular shaped strip.

14. The method of claim 12 wherein the sintered composite block has a cylindrical configuration prior to extrusion.

15. The method of claim 12 wherein the exposed peripheral block section is a surface of the extruded composite block that is intended as the top side electrical contact surface and the carrier layer material extends only in a bottom region of the semifinished product upon initial extrusion output.

16. The method of claim 12 wherein the partial encapsulation forms a wrap-around angle that extends for 180 degrees or less of the peripheral surface.

17. The method of claim 12 wherein the partial encapsulation extends about a cross-section of the block made of the contact material as to form a wrap-around angle of 90° to 270°.

18. The method of claim 1 wherein the partial encapsulation extends about a cross-section of the block made of the contact material as to form a wrap-around angle of 90° to 180°.

19. A method for producing a semifinished product for electrical contacts, wherein the semifinished product has a top side, which is intended for making the electrical contact and is made of a silver-based contact material, in which one or more metal oxides or carbon are incorporated, and a carrier layer, which bears the contact material and is readily solderable or weldable, said method having the following steps:

producing a block from the silver-based contact material with a cavity formed in the block, after producing the block, contacting a peripheral surface of the block with carrier layer material such that the carrier layer material fills the cavity and extends only partially about the peripheral surface so as to partially encapsulate the block, pressing the partially encapsulated block to compact the carrier layer material, in order to obtain a composite block, sintering the pressed composite block, in order to obtain a sintered composite block, extruding, though an extrusion die, the sintered composite block such that a portion of the sintered composite block entering and exiting the die has an exposed contact material surface.

20. The method of claim 19 wherein the partial encapsulation extends about a cross-section of the block made of the contact material as to form a wrap-around angle of 90° to 180°.

21. The method of claim 19 wherein the cavity is filled by thermal spraying of the carrier material.

22. The method of claim 19 wherein the cavity is filled with one or more sheets of carrier material.

23. The method of claim 19 wherein the cavity is filled by a powder of the carrier material.

* * * * *